US006933445B1

(12) United States Patent
Duesterhoeft et al.

(10) Patent No.: US 6,933,445 B1
(45) Date of Patent: Aug. 23, 2005

(54) ELECTRICAL CONTACT AND CONNECTOR

(75) Inventors: Scott Stephen Duesterhoeft, Etters, PA (US); Ronald Martin Weber, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/777,357

(22) Filed: Feb. 12, 2004

(51) Int. Cl.[7] ..... H01R 13/44

(52) U.S. Cl. ..... 174/84 C

(58) Field of Search ..... 174/84 C, 88 R; 439/877

(56) References Cited

U.S. PATENT DOCUMENTS 3,480,723 A * 11/1969 Golden ..... 174/88 R
3,541,227 A * 11/1970 Bendrick ..... 174/94 R
4,074,065 A * 2/1978 Leaf et al. ..... 174/87
4,263,474 A * 4/1981 Tennant ..... 174/84 C

* cited by examiner

*Primary Examiner*—Chau N. Nguyen

(57) ABSTRACT

A contact includes a body having a longitudinal dimension and a transverse dimension defining a first channel being configured to receive a conductor extending along the longitudinal direction, and a second channel configured to receive a conductor extending along the transverse dimension. At least one of a lance and a tooth extend from each of the first and second channels to secure the respective conductors thereto.

20 Claims, 8 Drawing Sheets

ELECTRICAL CONTACT AND CONNECTOR

BACKGROUND OF THE INVENTION

The invention relates generally to a power connector and, more particularly, to an electrical contact and connector configured for power distribution.

In the past, a variety of connectors have been utilized for power and signal distribution applications. A wide variety of electrical connectors exist for use today depending upon the environment and application for which it is intended. In some applications, multiple sets of wires are needed to be joined by an electrical connector for a variety of applications. Examples of such applications may be found in residential or commercial environments whenever cross connecting of different wires is required.

Specialized wire for performing electro-thermal conversion is commonly referred to as heater wire. Conventionally, heater wire may be fabricated from metallic or carbon-based materials and may include a single solid conductive strand or may include multiple conductive strands. Heater wire is used in a variety of applications including measurement systems, industrial heating processes, and in textile articles, such as electric blankets. Conventional connectors are configured to connect two wires, such as feed line and a specialized wire.

However, when the two wires are formed of dissimilar materials, conventional connectors are unable to join the wires reliably while facilitating power distribution between the wires. In addition, in certain applications, the two wires may be oriented perpendicular to one another and cross one another at a right angle at the point of intersection. A plurality of such wires may, for example, form a mesh pattern in an electric blanket. Existing connectors have not proven suitable to connect wires overlapping at a right angle. A need exists for a connector better suited to connect wires formed of dissimilar materials and oriented in a non-parallel relation.

BRIEF DESCRIPTION OF THE INVENTION

According to an exemplary embodiment, a contact is provided. The contact comprises a body having a longitudinal dimension and a transverse dimension, the body defining a first channel being configured to receive a conductor extending along the longitudinal direction, and a second channel configured to receive a conductor extending along the transverse dimension. At least one of a lance and a tooth extend from each of the first and second channels to secure the respective conductors thereto.

In another exemplary embodiment, a contact comprises a body having a longitudinal dimension and a transverse dimension, and lances located at each opposite end of the body. The lances are spaced apart to define a first channel along the longitudinal dimension, and the first channel is configured to receive a first wire. A plurality of teeth extend from the body and are located along the transverse dimension. The plurality of teeth spaced apart to define a second channel along the transverse dimension for receiving a second wire.

According to another exemplary embodiment, a contact assembly is provided. The contact comprises a body having a longitudinal dimension and a transverse dimension, a carrier strip, and a series of contacts coupled to the carrier strip. At least one contact in the series of contacts comprises lances located at opposite ends of the body. The lances are spaced apart to define a first channel along the longitudinal dimension, and the first channel is configured to receive a first wire. A plurality of teeth extend from the body, and the teeth are located along the transverse dimension. The plurality of teeth are spaced apart to define a second channel along the transverse dimension for receiving a second wire.

DETAILED DESCRIPTION OF THE INVENTION

Figure 1:
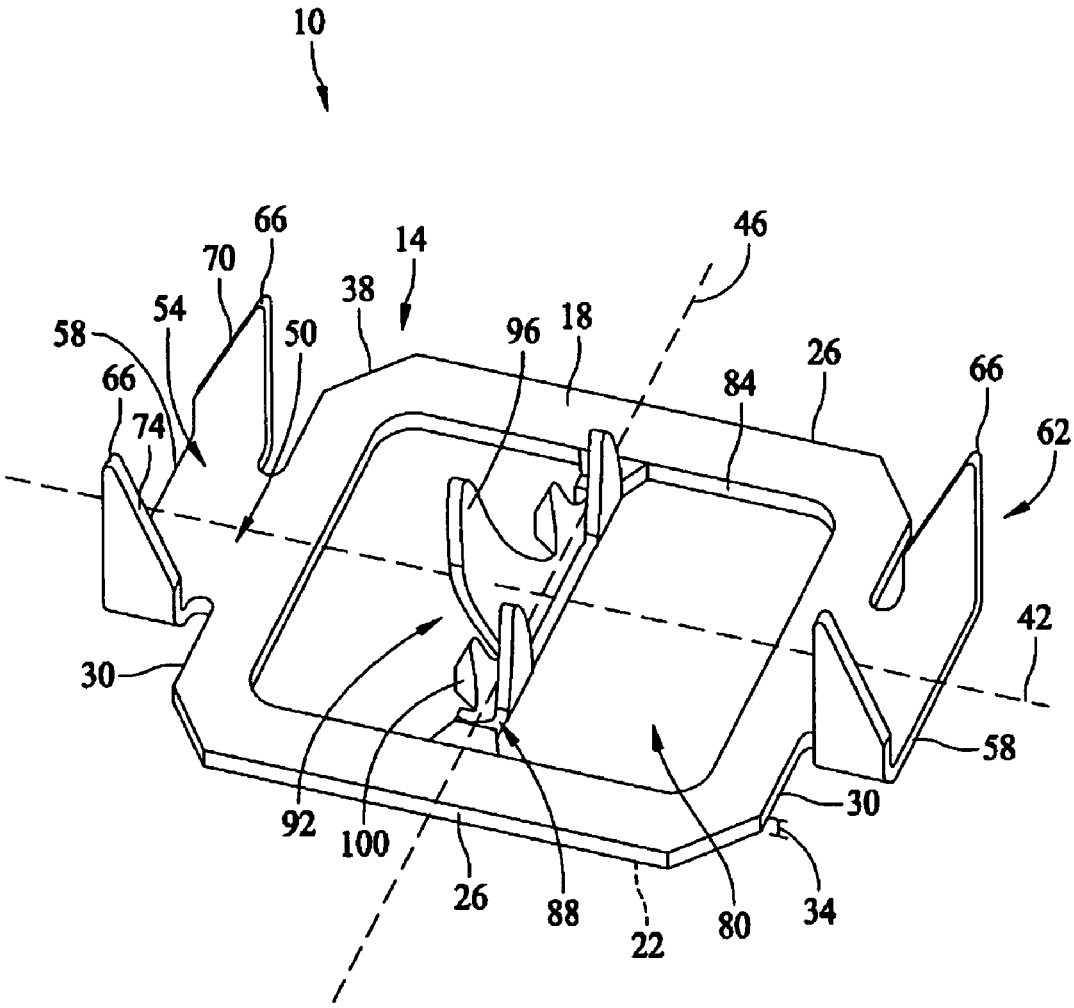
FIG. 1 is a perspective view of an electrical contact formed according to an embodiment of the present invention.

FIG. 1 is a perspective view of an electrical contact 10 formed according to an exemplary embodiment of the present invention and suited for connecting wires in an overlapping manner at right angles as described below. As illustrated in FIG. 1, the contact 10 has been formed into a pre-crimped shape adapted to receive wires therein. The contact 10 includes a body 14 having a planar top surface 18, a planar bottom surface 22, a pair of side edges 26, and a pair of opposed ends 30. A tapered edge 38 may be formed at the intersection of the side edges 26 and opposed ends 30.

Figure 2:
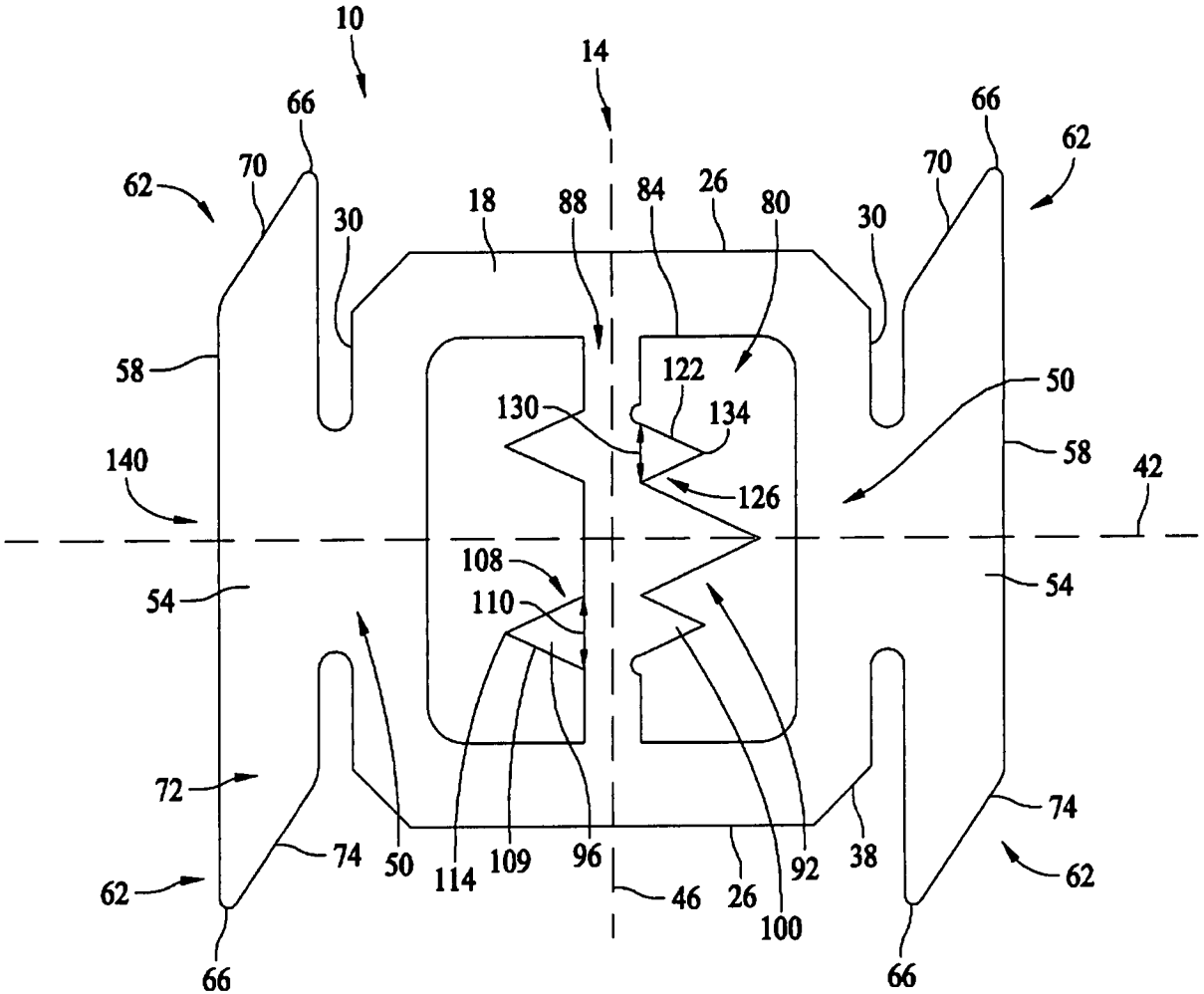
FIG. 2 is a top view of the electrical contact shown in FIG. 1 at a first stage of manufacture.

FIG. 2 is a top view of the contact 10 at a first stage of manufacture wherein the contact 10 is stamped from stock material, but before being formed or bent to the pre-crimped shape shown in FIG. 1. The body 14 has a length that extends along a longitudinal dimension, such as a longitudinal axis 42 (thereby defining a longitudinal dimension), and a width that extends along a transverse dimension, such as a transverse axis 46 (thereby defining a transverse dimension). As illustrated in FIG. 2, the contact 10 is wider along transverse axis 46 than it is long along longitudinal axis 42. Alternatively, the contact 10 may be formed with a substantially square envelope of substantially equal length and width, or the contact 10 may be circular, oval or any other alternative geometry as desired.

In an exemplary embodiment, the body 14 is formed integrally with at least one linking portion 50 extending from one of the opposed ends 30 to join at least one retainer portion 54 to the body 14. The retainer portions 54 are stamped in a generally planar arrangement with outer ends 58. The retainer portions 54 have at least one lance 62 extending laterally therefrom transverse to the longitudinal axis 42. Optionally, and as illustrated in FIG. 2, the retainer portions 54 include a pair of opposed lances 62 extending in opposite directions on each side of the longitudinal axis 42 before the contact 10 is formed or bent into the shape shown in FIG. 1. The lances 62 may be substantially triangular in shape with points 66 on distal ends thereof. The lances 62 extending from each respective linking portion 50 are formed with tapered edges 70 and 74. The tapered edges 70 and 74 extend in opposite directions on each side of the longitudinal axis 42 from the respective retaining portions 54 of the contact 10.

Additionally, the body 14 includes at least one opening 80 formed (by stamping or another known process) therethrough with an inner edge 84 extending from the top surface 18 to the bottom surface 22 (FIG. 1). The opening 80 is divided and spanned by a rib 88 extending along the transverse axis 46. As shown in FIG. 2, the rib 88 includes a plurality of teeth 92 extending laterally in opposite directions from the transverse axis 46 before bending or forming of the contact 10 to the pre-crimp shape shown in FIG. 1. The rib 88 extends across the body 14 parallel to the transverse axis 46. The rib 88 is formed integral with the body 14. Optionally, the rib 88 may be formed in a non-parallel relation with the transverse axis 46.

As shown in FIG. 2, the teeth 92 include crimping teeth 96 and piercing teeth 100. In an exemplary embodiment, the crimping teeth 96 are triangular in shape with side edges 109 and a base 108 having a width 110 that gradually decreases to a point 114. The piercing teeth 100 are also triangular in an exemplary embodiment and have side edges 122, and a base 126 with a width 130 that gradually decreases to a point 134. In further and/or alternative embodiments, the piercing teeth 100 may have additional teeth or barbs extending from the side edges 122, and the teeth 96 and 100 may be alternatively shaped in lieu of the triangular shapes illustrated herein. As shown in FIG. 2, at least one crimping tooth 96 is located opposed from a piercing tooth 100. Optionally, the crimping teeth 96 may be arranged in a staggered relation to the piercing teeth 100 along the transverse axis 46.

Figure 3:
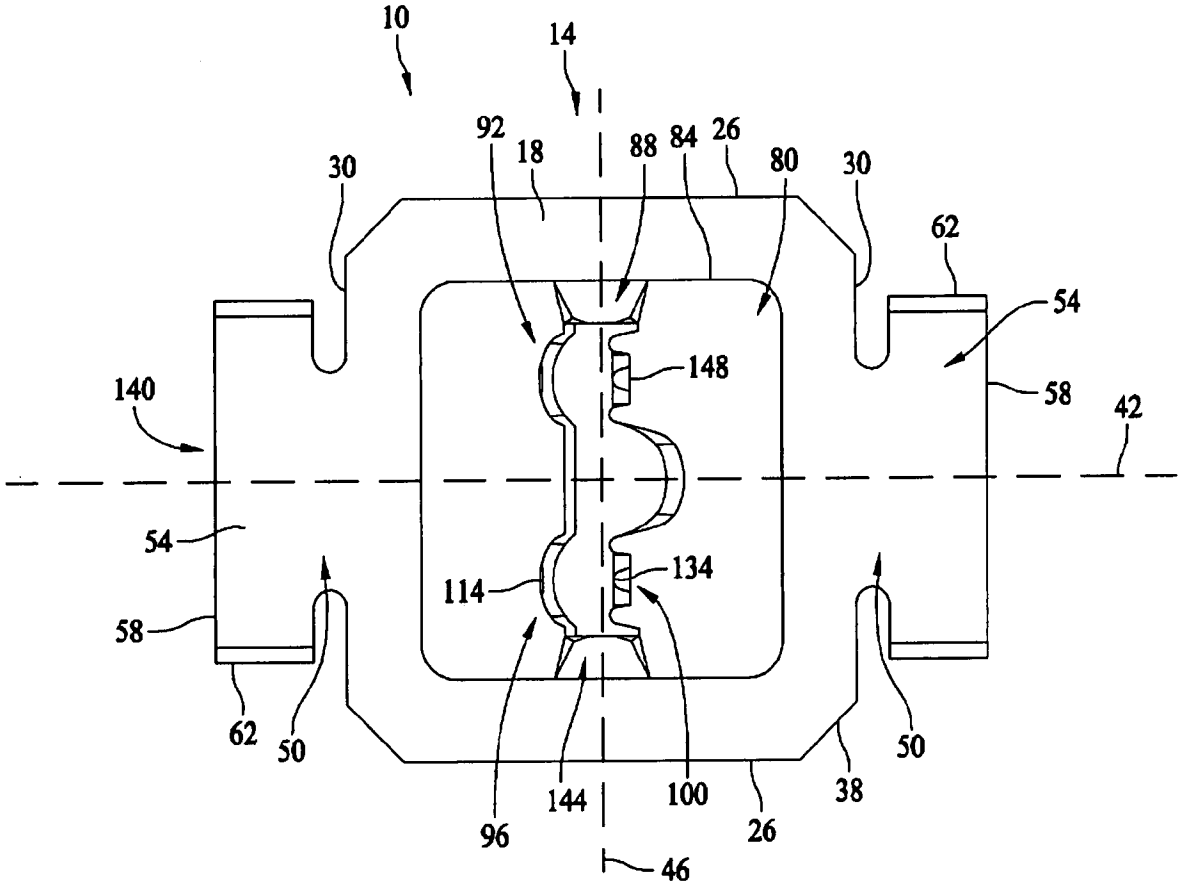
FIG. 3 is a top plan view of the electrical contact shown in FIG. 1.

FIG. 3 is a top view of the contact 10 after being formed or bent to the pre-crimped shape as shown in FIG. 1. The lances 62 extend substantially perpendicularly from the top surface 18 of the body 14. The lances 62 are spaced apart from one another along opposite sides of the longitudinal axis 42 to define a first channel 140 along the longitudinal dimension (i.e., substantially parallel to the longitudinal axis 42) for receiving a first wire or other current conducting member (not shown in FIG. 3). Optionally, the lances 62 may extend at acute angles from the top surface 18 to define the first channel 140. While in the illustrated embodiment the channel 140 is substantially centered upon the longitudinal axis 42, in another embodiment the channel 40 may be offset or off-centered with respect to the longitudinal axis 42.

The teeth 92 along the transverse axis 46 are bent to the pre-crimped shape to also extend substantially perpendicularly from the top surface 18 of the body 14. The teeth 92 of the rib 88 are spaced apart from one another along opposite sides of the transverse axis 46 to define a second channel 144 along the transverse dimension (i.e., substantially parallel to the transverse axis 46) for receiving a second wire or other current conducting member (not shown in FIG. 3). Optionally, the teeth 92 extend at an acute angle from the rib 88 to define the second channel 144. As shown in FIGS. 2 and 3, the first channel 140 is oriented substantially perpendicular to the second channel 144, thereby joining two mutually perpendicular wires or conductors as explained below. Optionally, the second channel 144 may be oriented at an acute angle with respect to the longitudinal axis 42 of the first channel 140. While in the illustrated embodiment the second channel 144 is substantially centered upon the transverse axis 46, in another embodiment the second channel 144 may be offset or off-centered with respect to the transverse axis 46.

Figure 4:
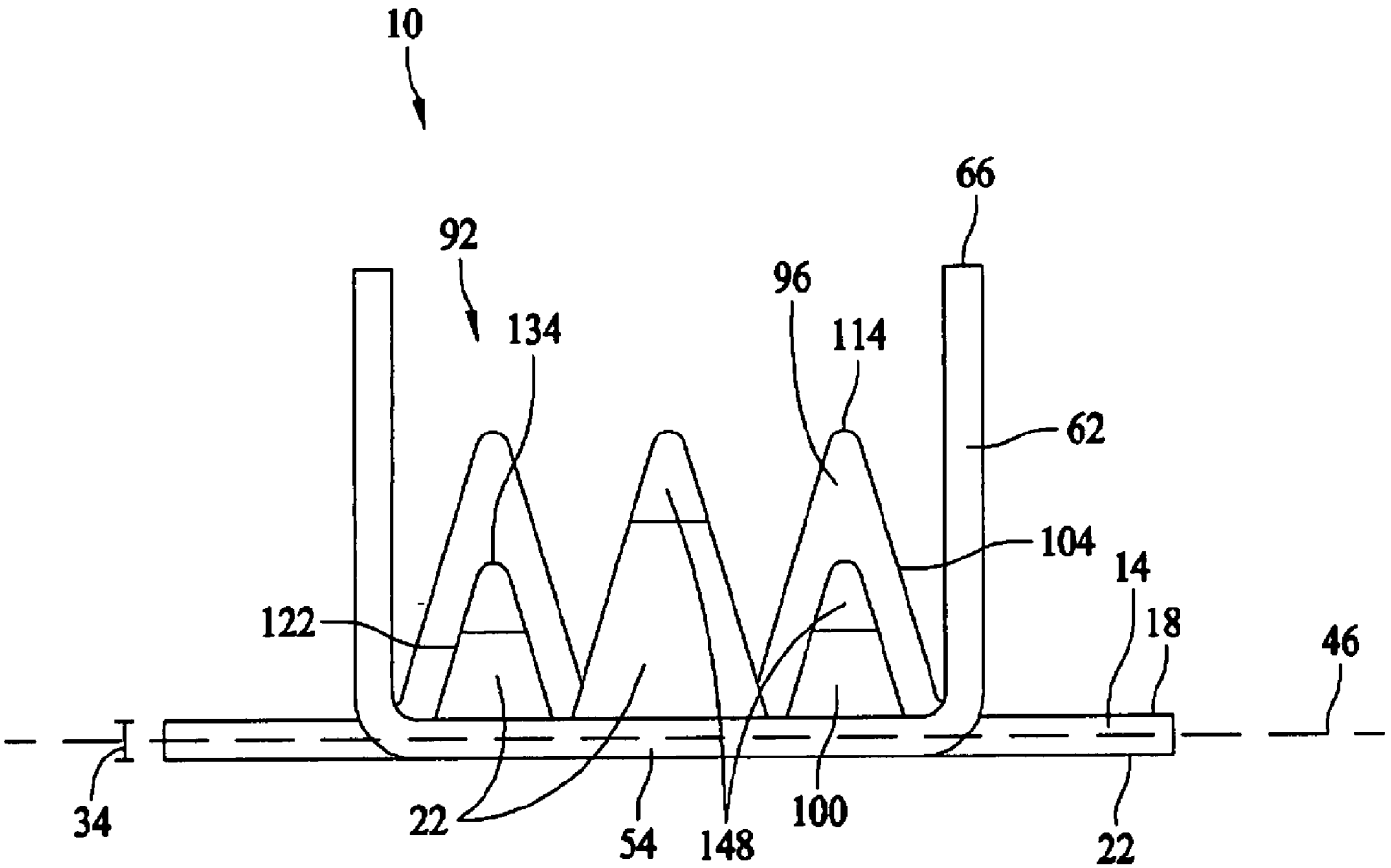
FIG. 4 is an end view of the electrical contact shown in FIG. 1 taken along a longitudinal dimension.

FIG. 4 is an end view of contact 10 taken along the longitudinal axis 42. The bottom surface 22 of the crimping teeth 96 and piercing teeth 100 have a chamfer 148 on a distal end thereof. Optionally, the top surface 18 of the crimping teeth 96 and piercing teeth 100 may have a chamfer (not shown) on a distal end thereof.

Figure 5:
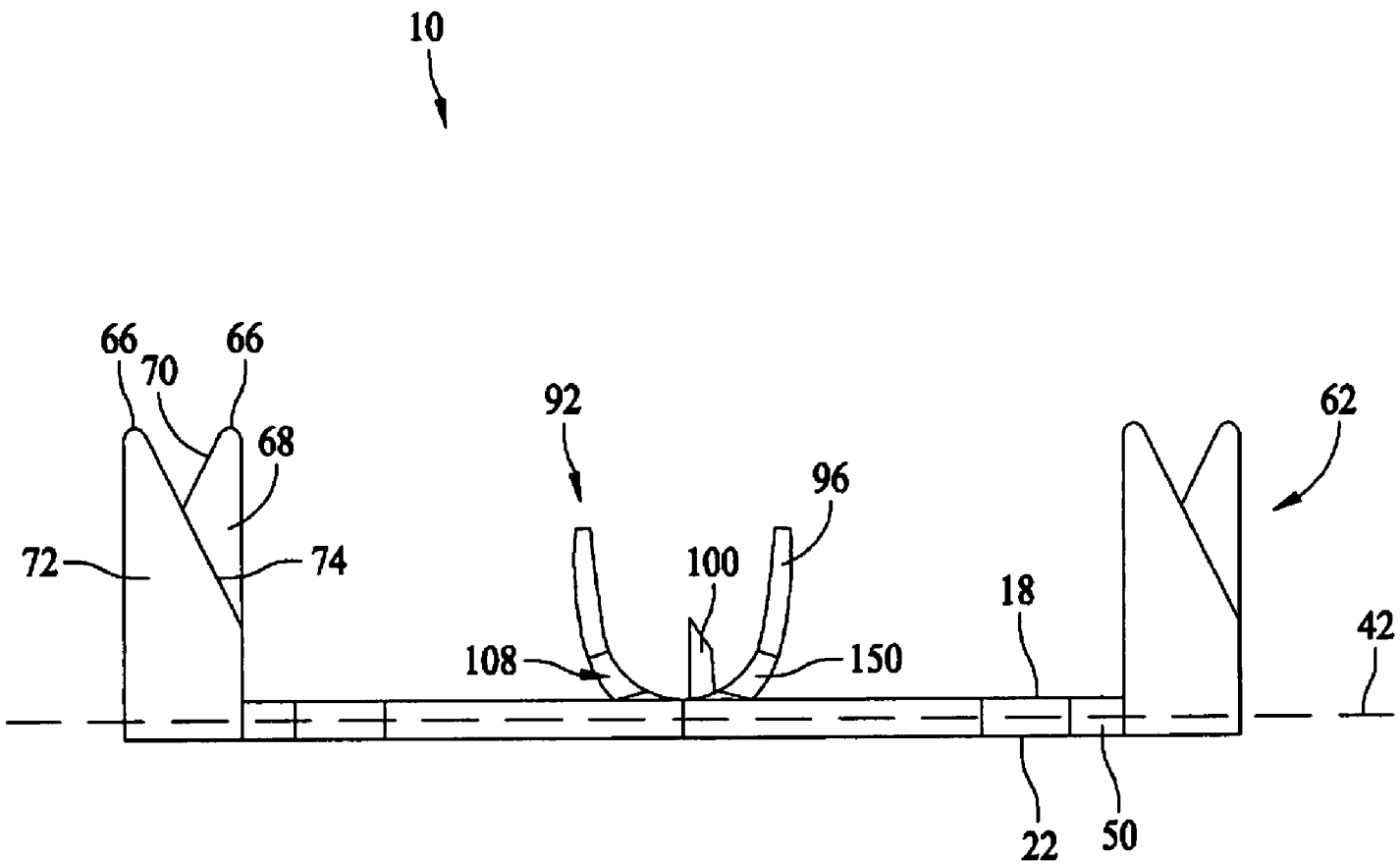
FIG. 5 is a side view of the electrical contact shown in FIG. 1 taken along a transverse dimension.

FIG. 5 is a side view of the contact 10 taken along the transverse axis 46. Each point 66 of the lances 62 is staggered or offset from the opposed lance 62 such that the tapered edges 70 and 74 of the lances 62 slope in opposite directions. As shown in FIG. 5, the crimping teeth 96 have bend portions 150 in the base 108 of the crimping tooth 96.

The contact 10 is configured to connect and retain the first and second wires that overlap, whereby the first and second wires are orientated substantially perpendicular to each other. Additionally, and as explained below, the contact 10 may interface two different wires formed of different materials. In use, a first wire is received in the first channel 140 and a second wire is received in the second channel 144.

Once the first and second wires are received in their respective channels, the lances 62 and the teeth 92 of the rib 88 are crimped to retain the first and second wires. When the lances 62 are crimped around the first wire, the point 66 of each lance 62 align with one another and retain the first wire in a staple like manner. As such, the lances 62 are well suited to secure an un-insulated wire or conductor.

When the second wire is received within the second channel 144, the piercing teeth 100 pierce insulation of the second wire while the crimping teeth 96 partially surround the second wire. Optionally, the crimping teeth 96 may substantially surround or encapsulate the second wire without piercing the insulation of the wire. In a further embodiment, a series of contacts 10 may be coupled to a carrier strip for application to the wires in an automated piece of equipment in a side feed or end feed configuration.

As such, in one example, the lances 62 secure an un-insulated conductor while the teeth 92 secure an insulated conductor. It is understood however, that the contact 10 may include lances 62 in both the longitudinal and transverse channels 140 and 144 an thus secure two un-insulated wires or conductors together, or alternatively, that the contact 10 may include piercing teeth 100 in both of the longitudinal and transverse channels 140 and 144 to secure two insulated conductors or wires to one another. In still another embodiment, crimping teeth 96 may be employed in both the longitudinal and transverse channels 140 and 144.

Figure 6:
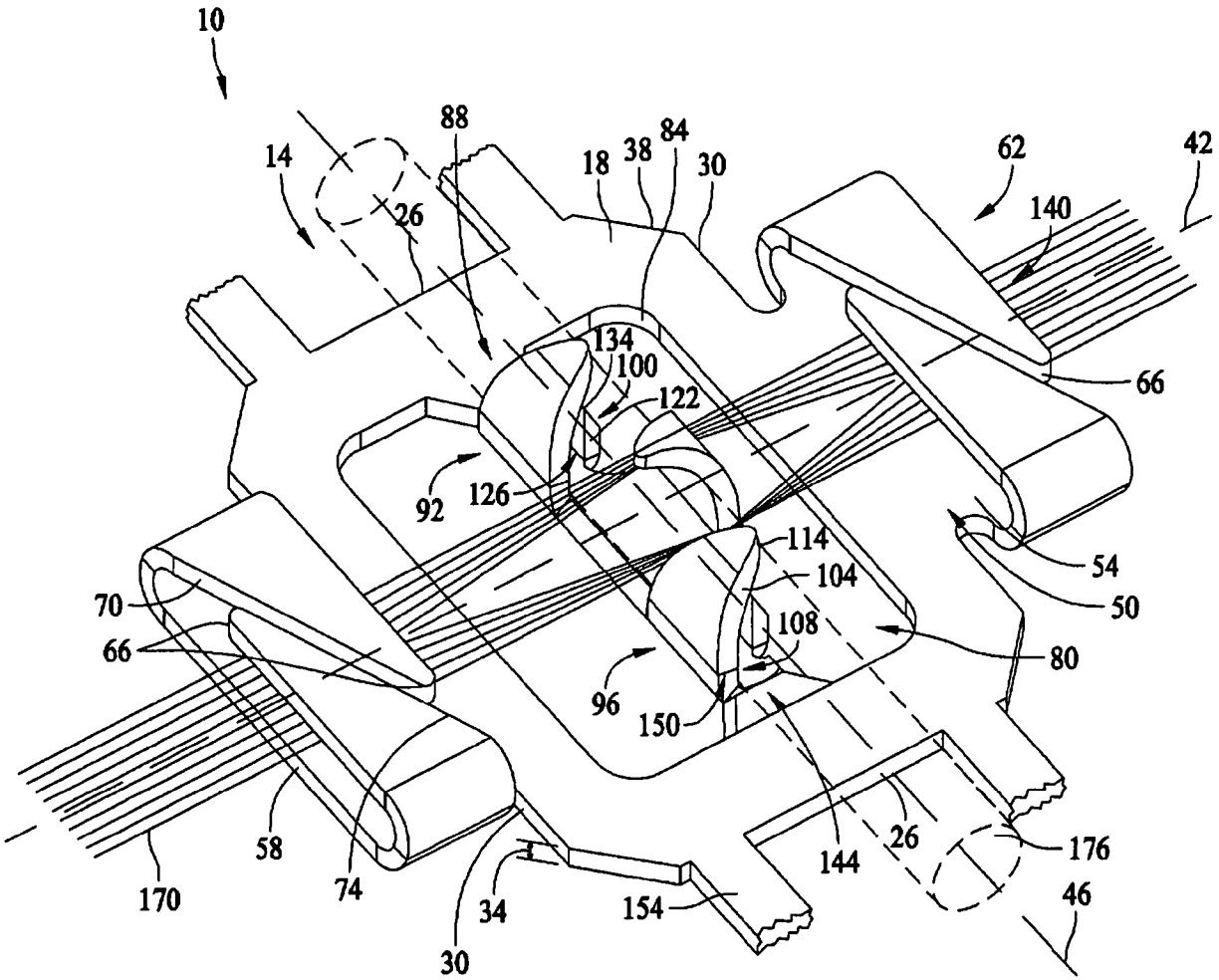
FIG. 6 is a perspective view of the electrical contact shown in FIG. 1 in a crimped form according to an embodiment of the present invention.

FIG. 6 is a perspective view of the contact 10 in crimped form according to an embodiment of the present invention. A first un-insulated wire 170 is secured within the first channel 140 by the lances 62. A second insulated wire 176 is secured within the second channel 144 by the plurality of teeth 92. In an exemplary embodiment, the wires 170 and 176 are secured to the contact 10 in a single manufacturing step, such as through one bending or crimping operation wherein the wires are more or less simultaneously secured to the contact 10, although it is contemplated that the wires could be separately secured to the contact 10 in sequential manufacturing steps if desired. The contact 10 has at least one linking strip 154 extending from one of the side edges 26. The contact 10 is coupled to a carrier strip which is severed from the contact before the contact 10 is secured to the wires 170 and 176. The points 66 of each lance 62 are offset and the complimentary slopes of each lance 62 enable the lances 62 in a pair to extend substantially parallel with one another in crimped form. The crimping teeth 96 are crimped such that the point 114 of each respective crimping tooth 96 extends over the point 134 of each corresponding piercing tooth 100. Optionally, the crimping teeth 96 may be crimped so that the point 114 of each respective crimping tooth 96 contacts the bottom surface 22 of the corresponding piercing tooth 100. The piercing tooth 100 pierces through the wire to establish contact with the conductive member therein.

Figure 7:
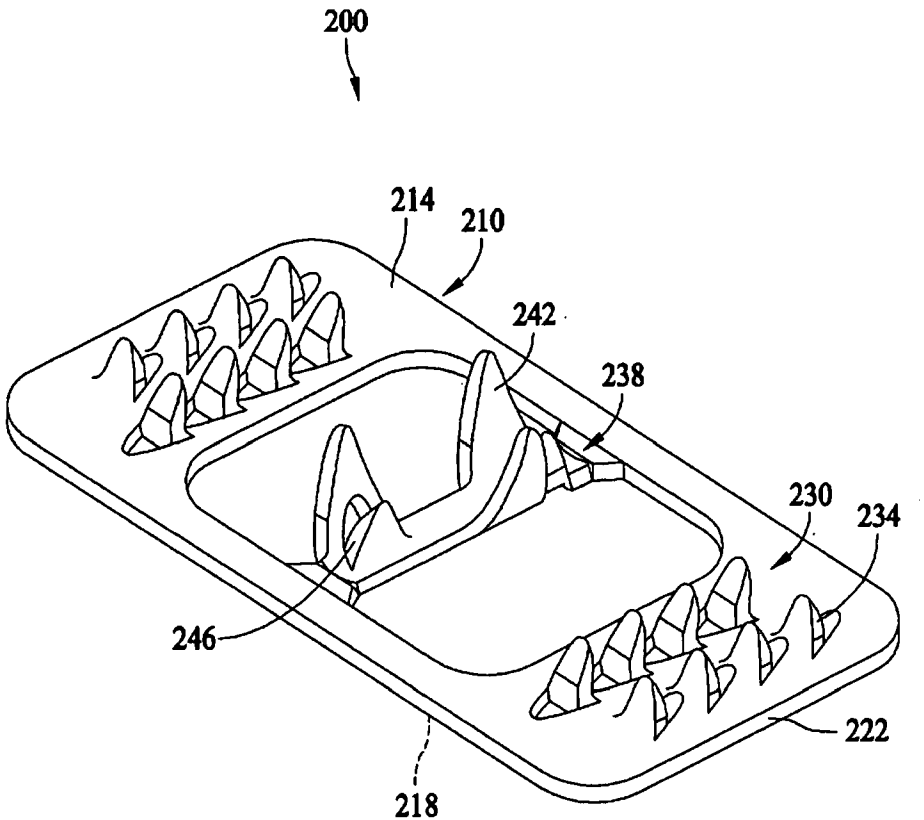
FIG. 7 is a perspective view of an electrical contact formed according to an alternative embodiment of the present invention.

FIG. 7 is a perspective view of a contact 200 formed according to an alternative embodiment of the present invention. The contact 200 includes a body 210 having a planar top surface 214, a planar bottom surface 218, a side edge 222 extending between the top and bottom surfaces 214 and 218. The contact 200 has at least one row 230 of piercing teeth 234 at opposite ends of the body 210. The piercing teeth 234 extend from the top surface 214 of the body 210. Optionally, the piercing teeth 234 in a row 230 may all point in the same direction. Optionally, a pair of rows 230 extending across the top surface 214 of the body 210 may be substantially parallel to each other. Optionally, the piercing teeth 234 in one row may be pointed in an opposite direction than the piercing teeth 234 in the other row. The contact 200 has a rib 238 with a plurality of crimping teeth 242 and piercing teeth 246.

When the contact 200 is secured to a wire, the piercing teeth 246 pierce through wire insulation to establish contact with the conductive member therein. The piercing teeth 246 may be omitted in applications where bare or stripped (i.e., un-insulated) wires or conductors are employed. Teeth 234 are used to establish contact with un-insulated conductors similar to lances 62 in contact 10.

Figure 8:
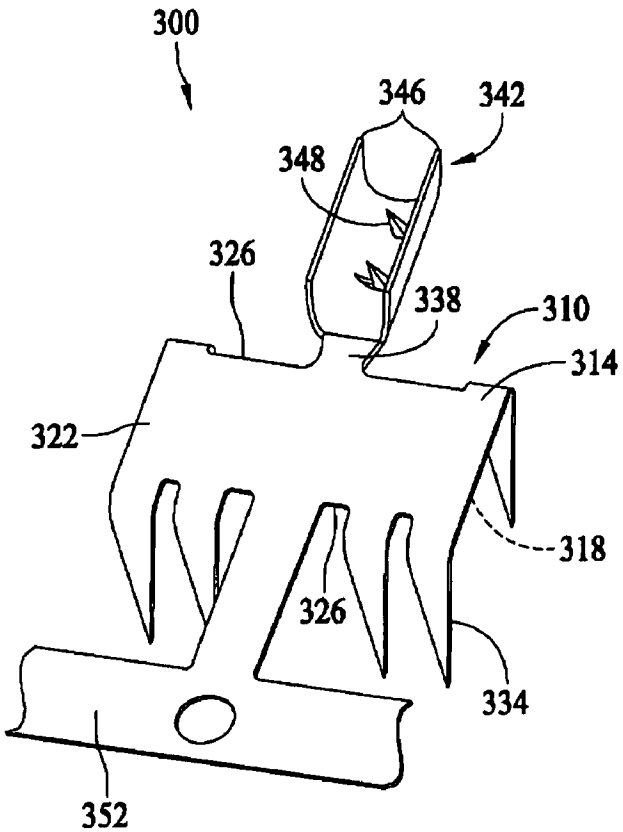
FIG. 8 is a perspective view of an electrical contact formed according to another alternative embodiment of the present invention.

FIG. 8 is a perspective view of a contact 300 formed according to an alternative embodiment of the present invention. The contact 300 includes a body 310 having a planar top surface 314, planar bottom surface 318, a pair of side edges 322, and a pair of opposed edges 326. The side edges 322 and the opposed edges 326 extend from the top surface 314 to the bottom surface 318. The body 310 has crimping fingers 334 extending from the opposed edges 326 therefrom. Optionally, the body 310 has piercing teeth (not shown) extending from the bottom surface 318. The crimping fingers 334 pierce through a material or pierce and surround an un-insulated conductor. The body 310 is formed integral with a linkage portion 338 extending from one of the side edges 322 to join a wire retainer 342 to the body 310. The wire retainer 342 has opposed ends 346 and at least one piercing tooth 348 extending from the top surface 314. A wire is received within the wire retainer 342 and aligned with the linkage portion 338. Opposite ends 346 of the wire retainer 342 are bent or crimped around the wire and the piercing tooth 348 pierces the wire to establish contact with the conductive member therein. Optionally, the body 310 is coupled to a carrier strip 352, and the carrier strip 352 is removed as the wires are terminated or crimped to the contact 300.

In one embodiment, a conductive material (not shown) having a matrix of wires woven or otherwise incorporated into a nonconductive material or fabric may be employed as one of the conductors for the first and/or second wires extending along the horizontal and vertical dimensions of one of the foregoing contacts 10, 200, 300. In one embodiment, the horizontal wire or the first wire is an un-insulated feed line which carries current. The vertical wire or the second wire is substantially perpendicular to the first wire and is an insulated sensor wire for measuring temperature. The first wire includes a first material and the second wire includes a second material which is different from the first material. In one embodiment, the first or second wire has an insulated housing. In another embodiment, the first or second wire is formed from a grouping of smaller strands of wire.

While the invention has been described in terms of various specific embodiments, those skilled in the art will recognize that the invention can be practiced with modification within the spirit and scope of the claims.

What is claimed is:

1. A contact comprising:

a body defining a longitudinal dimension and a transverse dimension, said body defining a first channel configured to receive a conductor extending across said body along the longitudinal dimension; and said body defining a second channel overlapping and crossing said first channel, said second channel configured to receive a conductor extending across said body along the transverse dimension, and at least one of a lance and a tooth extending from each of said first and second channels to secure said respective conductors thereto.

2. The contact according to claim 1 wherein one of said first and second channels comprises at least one pair of lances at opposed ends thereof.

3. The contact according to claim 1 wherein said tooth is configured to pierce and retain the conductor received in the respective channel.

4. The contact according to claim 1 wherein one of said first and second channels comprises at least two teeth extending therefrom.

5. The contact according to claim 1 wherein said body has at least one opening divided by a rib formed integral to said body, said rib defining said second channel, said tooth extending from said rib.

6. The contact according to claim 1 wherein said first and second channels are substantially perpendicular to one another.

7. The contact according to claim 1 wherein said tooth is configured for crimping said conductor disposed along said transverse dimension.

8. A contact comprising:

a body having a longitudinal dimension and a transverse dimension;

lances located at each opposite end of said body, said lances being spaced apart to define a first channel along said longitudinal dimension, said first channel being configured to receive a first wire across said body; and a plurality of teeth extending from said body, said teeth being located along said transverse dimension, said plurality of teeth spaced apart to define a second channel along said transverse dimension for receiving a second wire across said body, said second wire overlapping and crossing said first wire.

9. The contact according to claim 8 wherein said lances extend substantially perpendicular from said body.

10. The contact according to claim 8 wherein said plurality of teeth extend substantially perpendicular from said body.

11. The contact according to claim 8 wherein at least one lance is offset from the another lance with respect to said transverse dimension.

12. The contact according to claim 8 wherein said lances are crimped around the first wire to surround the first wire.

13. The contact according to claim 8 wherein said first wire is an un-insulated wire, wherein said lances are crimped in a staple-like manner around the first wire.

14. The contact according to claim 8 wherein said second wire comprises an insulated wire, said contact comprising plurality of teeth includes at least one tooth for piercing the second wire.

15. The contact according to claim 8 wherein said plurality of teeth includes at least one tooth for crimping the second wire.

16. The contact according to claim 8 wherein said plurality of teeth include at least two crimping teeth and one piercing tooth.

17. The contact according to claim 8 wherein the first and second wires are fabricated from different materials.

18. A contact assembly comprising:

a body having a longitudinal dimension and a transverse dimension intersecting the longitudinal dimension;

a carrier strip; and a series of contacts coupled to said carrier strip, at least one contact in said series of contacts comprising:

lances located at opposite ends of said body, said lances being spaced apart to define a first channel along said longitudinal dimension, said first channel being configured to receive a first wire; and a plurality of teeth extending from said body, said teeth being located along said transverse dimension, said plurality of teeth spaced apart to define a second channel along said transverse dimension for receiving a second wire, said first and second channels overlapping one another and said wires crossing one another when received therein.

19. The contact assembly according to claim 18 wherein said lances at opposite ends of said body are crimped to retain the first wire disposed in said first channel.

20. The contact assembly according to claim 18 wherein said plurality of teeth includes at least one tooth for piercing the second wire disposed in said second channel.

* * * * *